US008113581B2

(12) United States Patent
Goeckel

(10) Patent No.: US 8,113,581 B2
(45) Date of Patent: Feb. 14, 2012

(54) SUPPORTIVE BACK OVERLAY FOR WHEELCHAIR BACK

(75) Inventor: Gregory W. Goeckel, Belleville, IL (US)

(73) Assignee: Roho, Inc., Belleville, IL (US)

( * ) Notice: Subject to any disclaimer, the term of this patent is extended or adjusted under 35 U.S.C. 154(b) by 0 days.

(21) Appl. No.: 13/239,752

(22) Filed: Sep. 22, 2011

(65) Prior Publication Data

US 2012/0007396 A1 Jan. 12, 2012

Related U.S. Application Data

(63) Continuation of application No. 12/669,686, filed as application No. PCT/US2008/067500 on Jun. 19, 2008.

(60) Provisional application No. 60/961,912, filed on Jul. 25, 2007.

(51) Int. Cl.
*A47C 7/42* (2006.01)

(52) U.S. Cl. ..... 297/230.11; 297/230.1; 297/230.12; 297/230.13; 297/219.1; 297/440.2; 297/DIG. 4

(58) Field of Classification Search ..... 297/219.1, 297/230.1, 230.11, 230.12, 230.13, 440.2, 297/440.22, DIG. 4, 397
See application file for complete search history.

(56) References Cited

U.S. PATENT DOCUMENTS

| | | | | | |
|---|---|---|---|---|---|
| 614,153 | A | * | 11/1898 | West | 297/230.11 |
| 1,006,381 | A | * | 10/1911 | Hess | 297/230.12 X |
| 1,412,037 | A | * | 4/1922 | Beynon | 297/230.11 |
| 1,444,014 | A | * | 2/1923 | Truesdell | 297/230.11 X |
| 1,444,536 | A | * | 2/1923 | Boyce | 297/230.12 X |
| 1,975,586 | A | * | 10/1934 | Law | 297/230.11 |
| 2,008,392 | A | * | 7/1935 | Heller | 297/230.1 X |
| 2,060,298 | A | * | 11/1936 | Gailey | 297/230.13 |
| 2,191,360 | A | * | 2/1940 | Westenbarger | 297/230.11 |
| 2,260,352 | A | * | 10/1941 | Trapani | 297/230.11 X |
| 2,528,412 | A | * | 10/1950 | Bickler | 297/230.11 |
| 2,659,420 | A | * | 11/1953 | Burke | 297/230.1 |
| 2,756,808 | A | * | 7/1956 | Eichorst | 297/230.11 |
| 2,807,313 | A | * | 9/1957 | Kaufman | 297/230.13 |
| 2,835,311 | A | * | 5/1958 | Reeves et al. | 297/230.11 |
| 2,838,099 | A | * | 6/1958 | Warner | 297/230.1 |
| 3,062,586 | A | * | 11/1962 | Rowland | 297/230.11 X |
| 3,336,078 | A | * | 8/1967 | Haley | 297/440.21 X |
| 3,348,880 | A | * | 10/1967 | Swann | 297/230.1 X |
| 3,513,930 | A | * | 5/1970 | Brown, Jr. | 297/440.2 X |
| 3,556,589 | A | * | 1/1971 | Messier | 297/230.12 |
| 3,610,685 | A | * | 10/1971 | Lay | 297/230.12 |
| 3,679,261 | A | * | 7/1972 | Slabakov | 297/230.11 |
| 3,813,148 | A | * | 5/1974 | Kraus | 297/230.14 |
| 3,934,933 | A | * | 1/1976 | Long | 297/219.1 |
| 5,364,162 | A | * | 11/1994 | Bar et al. | 297/440.2 X |
| 5,461,741 | A | * | 10/1995 | Graebe | 5/654 |

(Continued)

*Primary Examiner* — Rodney B White
(74) *Attorney, Agent, or Firm* — Polster Lieder Woodruff & Lucchesi, L.C.

(57) ABSTRACT

A supportive back rest for attachment to an original equipment back rest of a wheelchair to enhance the supportive characteristics of the wheelchair back rest. The supportive back rest includes a cushion, a suspension element and a cover. The cushion and one side of the suspension element are positioned in the cover. An opposed side of the suspension element is exposed and defines a space between it and the cushion. The suspension element slips over the upper edge of the original equipment back rest of the wheelchair to suspend the supportive back rest in position behind a seated user. The suspension element can be attached to the cover or can be attached to the cushion by molding or through attachment anchors.

14 Claims, 7 Drawing Sheets

U.S. PATENT DOCUMENTS 5,524,969 A * 6/1996 Harrison et al. ..... 297/440.2 X
5,524,971 A * 6/1996 Jay et al. ..... 297/440.2 X
5,588,445 A * 12/1996 Obaidi ..... 297/230.1 X
D407,353 S * 3/1999 Bar et al. ..... D12/133
D412,685 S * 8/1999 Bar et al. ..... D12/133
D413,085 S * 8/1999 Bar et al. ..... D12/133
D413,841 S * 9/1999 Bar et al. ..... D12/133
6,095,611 A * 8/2000 Bar et al. ..... 297/440.21
6,123,389 A * 9/2000 O'Connor et al. ..... 297/397
6,305,749 B1 * 10/2001 O'Connor et al. ..... 297/397
6,474,743 B1 * 11/2002 Harker et al. ..... 297/440.21
6,644,750 B1 * 11/2003 Sandman et al. ..... 297/440.21
6,648,416 B2 * 11/2003 O'Connor et al. ..... 297/397
6,893,094 B2 * 5/2005 O'Connor ..... 297/397
6,971,717 B1 * 12/2005 Rhodes ..... 297/230.1
6,988,772 B2 * 1/2006 Rutty ..... 297/230.1 X
7,093,903 B2 * 8/2006 O'Connor et al. ..... 297/397
7,422,282 B2 * 9/2008 Rutty ..... 297/230.11
7,448,682 B2 * 11/2008 Rutty ..... 297/230.1
7,469,963 B2 * 12/2008 Rutty ..... 297/230.1
7,686,393 B2 * 3/2010 Rutty ..... 297/230.11
7,703,849 B2 * 4/2010 Bilak et al. ..... 297/230.13 X
7,909,399 B2 * 3/2011 Rutty ..... 297/230.11
2005/0269848 A1 * 12/2005 Harley ..... 297/230.1

* cited by examiner

SUPPORTIVE BACK OVERLAY FOR WHEELCHAIR BACK

CROSS-REFERENCE TO RELATED APPLICATIONS

This application is a continuation of application Ser. No. 12/669,686, filed Jan. 19, 2010, which is a U.S. national stage application under 35 U.S.C. §371 of PCT/US/2008/067500, filed Jun. 19, 2008, which claims priority to provisional application Ser. No. 60/961,912, filed Jul. 25, 2007, all of which are incorporated herein by reference.

BACKGROUND OF THE INVENTION

The invention relates generally to seating and more specifically an attachment to the original equipment back of a chair, for example a wheelchair, to enhance support characteristics of the back, and more specifically to a supportive back overlay that can be attached to the original sling or soft back of a wheel chair or other chair to provide added support.

Wheelchairs generally are constructed from a metal frame having the overall configuration of a chair. The frame includes wheels on the bottom so that the wheelchair can be moved about to increase mobility of the seated user. The wheelchair frame supports a seat extending between two sides of the frame and usually includes arm rests on each side of the seat for comfort and stability. The frame includes vertically extending back support posts with a back support structure extending between the posts to support the seated user's back. In many styles of wheelchairs, the seat and the back support or both are constructed from a flexible material, such as canvas cloth, vinyl or the like. Since these materials are flexible, they generally bow or assume a concave configuration when the user is seated and resting against the back support. These types of back supports are sometimes referred to as sling backs.

Many users find these flexible back supports to be uncomfortable and desire firmer support and less bowing behind their backs. Replacement back supports constructed from substantially rigid materials are known, but usually require removal of the original back support, modification of the frame and mounting of the replacement back support to the frame with hardware using tools. Hence, the replacement back is not simple to attach and once the replacement back is attached, it is cumbersome and time consuming to remove. This can be particularly problematic for an injured or disabled individual who requires the use of a wheelchair and may have no help in modifying his or her wheelchair. It would be advantageous, therefore, to have a substantially firm back support that can be easily and conveniently attached to or removed from the back of a wheelchair, or any other chair, without the use of hardware or tools.

SUMMARY OF THE INVENTION

A supportive back overlay that can be used on the back of a chair, for example a wheelchair, which can be attached to the original back by a suspension element. One aspect of the supportive back overlay comprises a supportive cushion with a suspension element that slips over the original equipment chair back to hold the cushion in position behind a seated user's back. The suspension element can be associated with the supportive cushion in any acceptable manner. Representative or illustrative aspects of association include, but are not limited to, securing the in the cushion cover, by molding it into the cushion itself, or by attaching it to anchors that are affixed to the cushion.

DETAILED DESCRIPTION

Figure 1:
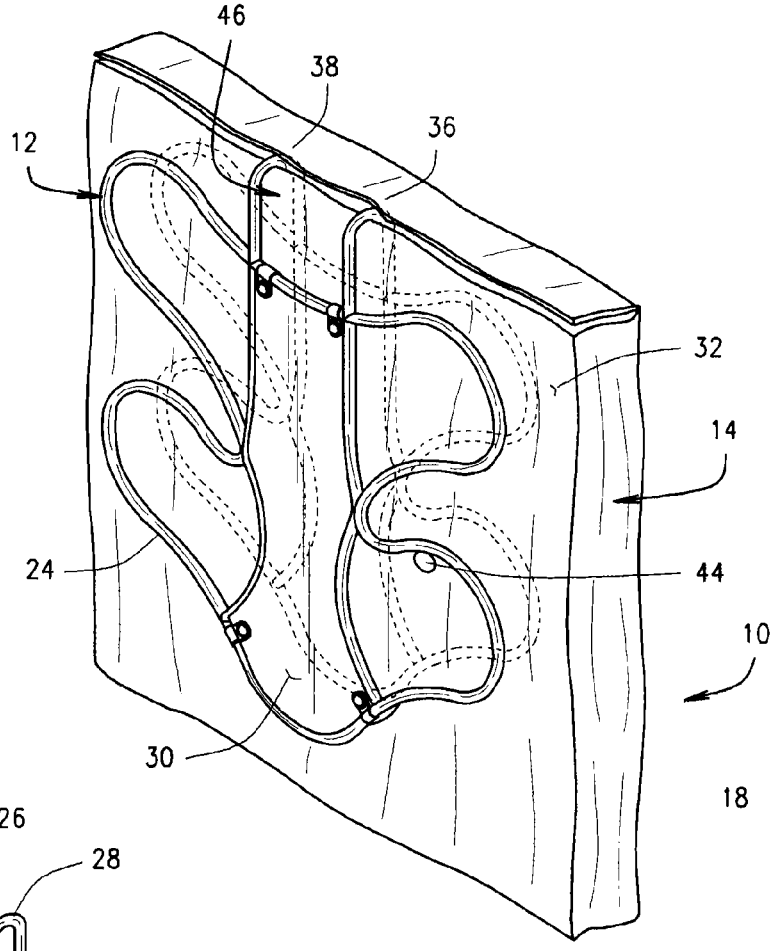
FIG. 1 is a rear perspective view of a supportive back overlay.
Figure 2:
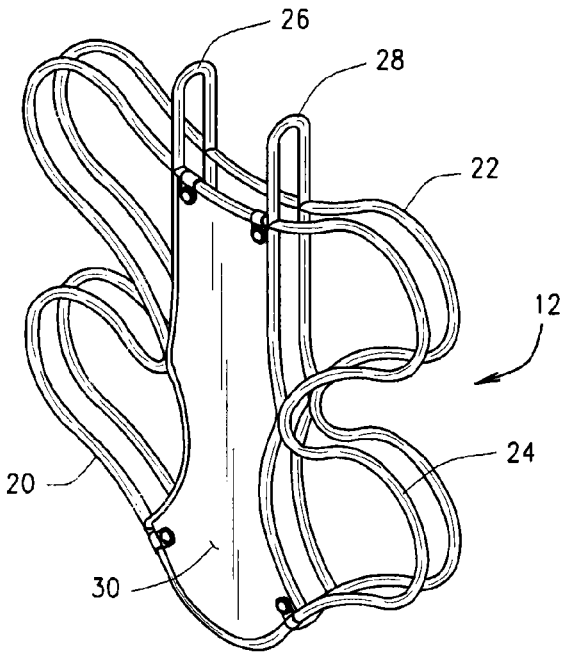
FIG. 2 a perspective view of one embodiment of a supportive back overlay suspension element.
Figure 3:
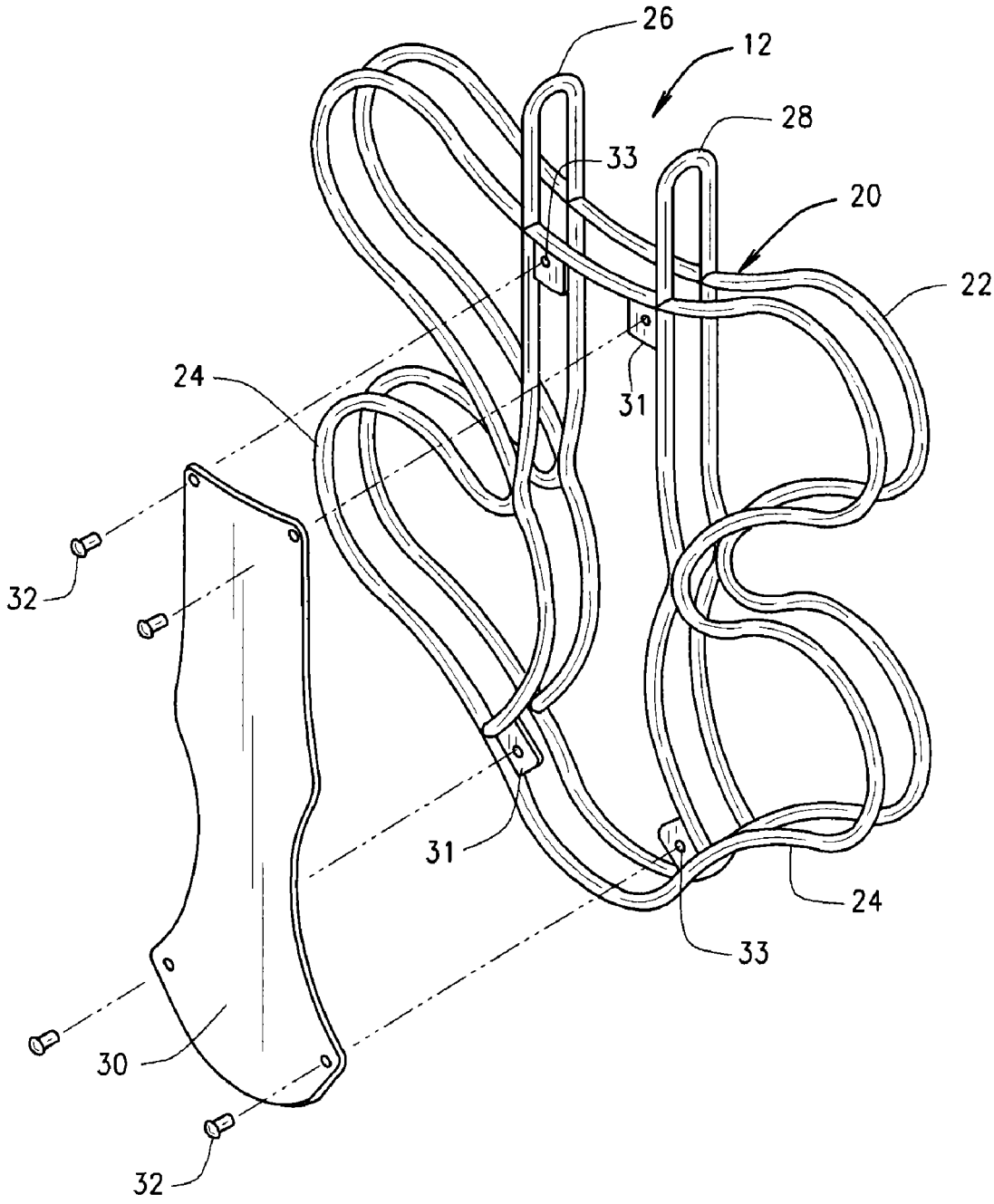
FIG. 3 is an exploded rear perspective view of the suspension element.
Figure 4:
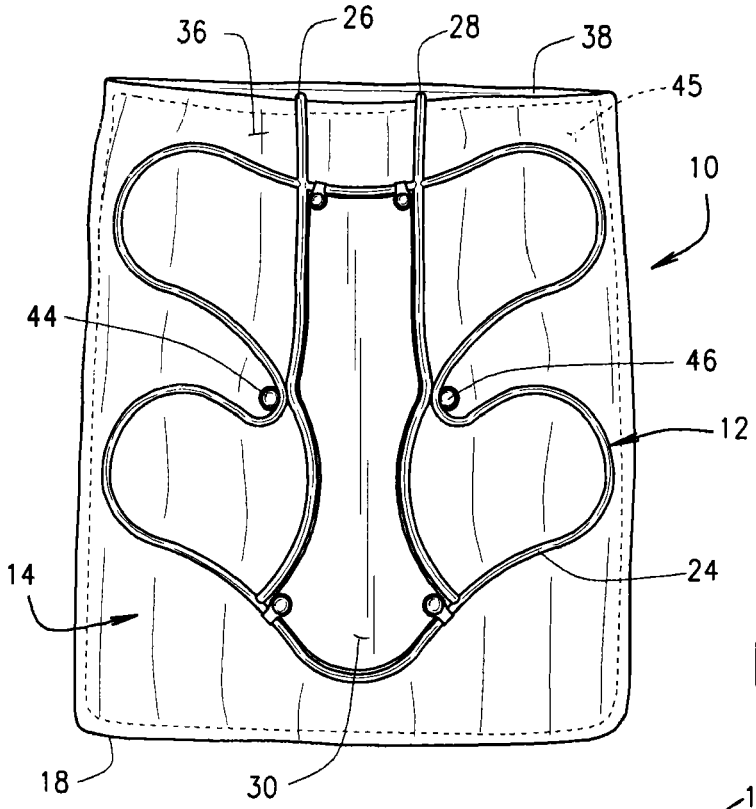
FIG. 4 a rear plan view of a supportive back overlay.
Figure 5:
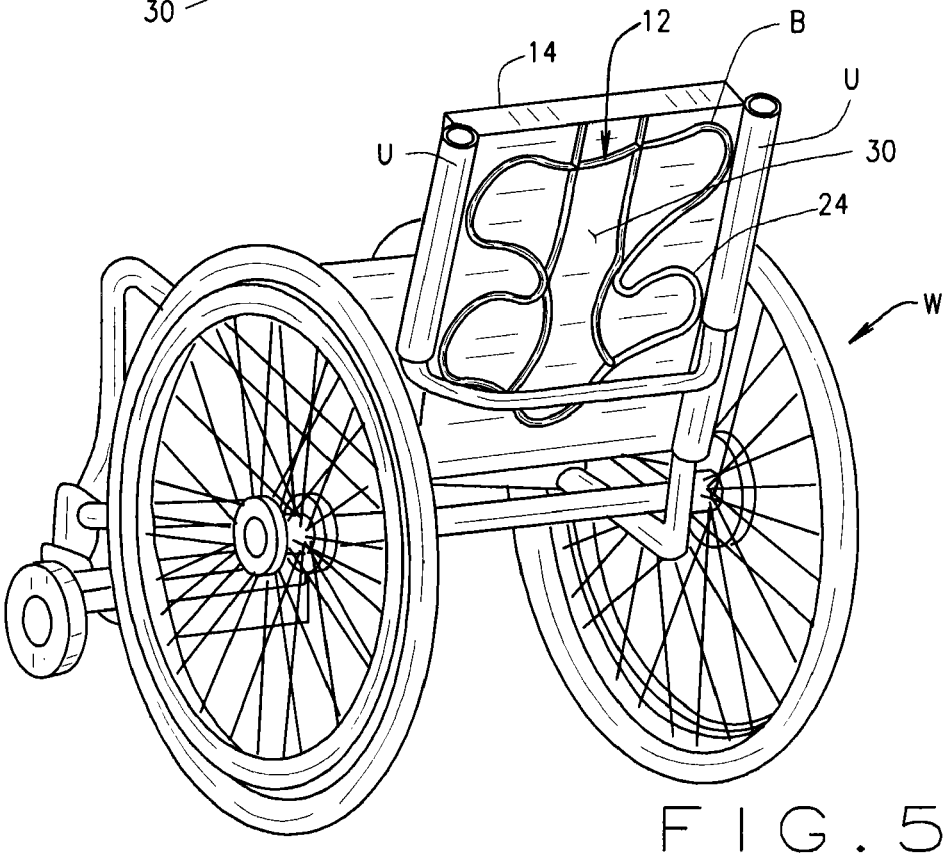
FIG. 5 is rear a perspective view of a wheelchair employing the supportive back overlay.

One aspect of a supportive back overlay is indicated generally by reference number 10 in the figures. In general, the supportive back overlay 10 includes a suspension element 12, which also may be referred to as a clip, and a support element 14. The support element includes a cushion 16 and a cover 18. Suspension element 12, also referred to as a clip, comprises a frame 20 having opposed, spaced apart mirror image sections 22 and 24, respectively, which are connected at the top by bails 26 and 28. The bails 26, 28 are designed to extend over or hang on the upper edge of a back of a chair, for example, over sling back B of wheelchair W as seen in FIG. 5. It will be appreciated that supportive back 10 can be easily placed or hung on the sling back and does not require any mounting hardware or tools to install.

Wheelchair W, as illustrated, is conventional in design having a rigid frame F. Of particular interest is that wheelchair W includes a conventional original equipment sling back B and a seat S. In general the wheelchair sling back B is constructed from a substantially flexible material, such as a canvas, fabric or even vinyl and is attached between two upright back elements U of the wheelchair frame. In any event, the sling back B generally is not rigid and can bow, and hence offers less support and comfort when a user is positioned on seat S and leans back against sling back B. Although supportive back 10 is illustrated in use on a wheelchair, it will be understood that the scope of the present invention is intended to cover any use of the supportive back on any type of seating structure that employs its own original equipment back. The bails are placed over sling back B and the support element 14 is held suspended against the front side of the sling back B, where it can support the back of a user seated in the wheelchair. The suspension element 12 can be formed from a heavy gauge wire, such as stainless steel wire. The illustrated configuration has a lobed design, which is aesthetically pleasing. The ornamental design is not critical, however, and in one aspect of the invention, suspension element 12 has sufficient width to extend across a substantial area of the sling back B. This adds to the stability and support characteristics of supportive back 10.

Figure 6:
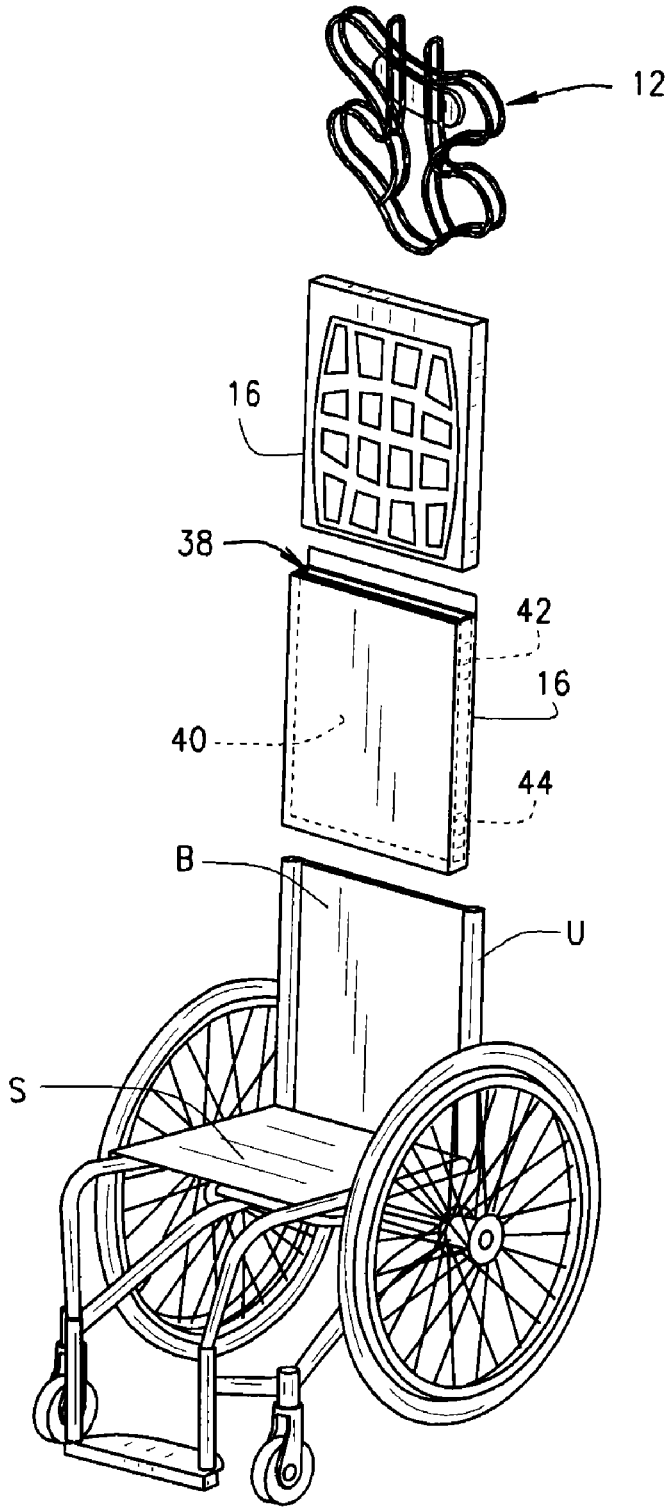
FIG. 6 is an exploded front perspective view of a wheelchair and supportive back overlay.

The back section 24 of the suspension element is visible on the back surface of the sling back B and includes an optional inlay 30 made of Plexiglas in the illustrated embodiment. Inlay 30, as shown, primarily is decorative and can bear indicia 32, such as the company name or logo. There can be any form of ornamentation of structures in the area occupied by inlay 30, without departing from the scope of the invention. As seen in FIG. 6, inlay 30 has attachment holes 31 is secured to bosses 31 which are integral with the frame by fasteners 32 through holes 33 in the bosses. The front section 22 of frame 20 is secured in the cover 18, as will be described below. It will be appreciated that, although suspension element 12, as illustrated, comprises a wire frame, any type of suspension element that allows easy attachment of the supportive back over the sling back B is acceptable and intended to be within the scope of the invention and claims. It could simply be a U-shaped element with substantially flat solid sections or any other design that accomplishes the intended purpose.

Cushion 16, as shown, can be a constructed of foam such as a medium density foam. However, soft or high density foam also may be used as long as the foam can be properly formed or molded. Alternatively, cushion 16 can be an air cell cushion, similar to those disclosed in U.S. Pat. No. 4,541,136, which is incorporated herein by reference. Cushion 16 provides a comfortable, yet supportive surface on which the user can rest his or her back. The cushion 16 generally has some flexibility or "give" when pressure is applied, but does not yield or bow as much as the original seat back and provides good support and stability and prevents the seated user from sinking or tilting back too far.

Figure 7:
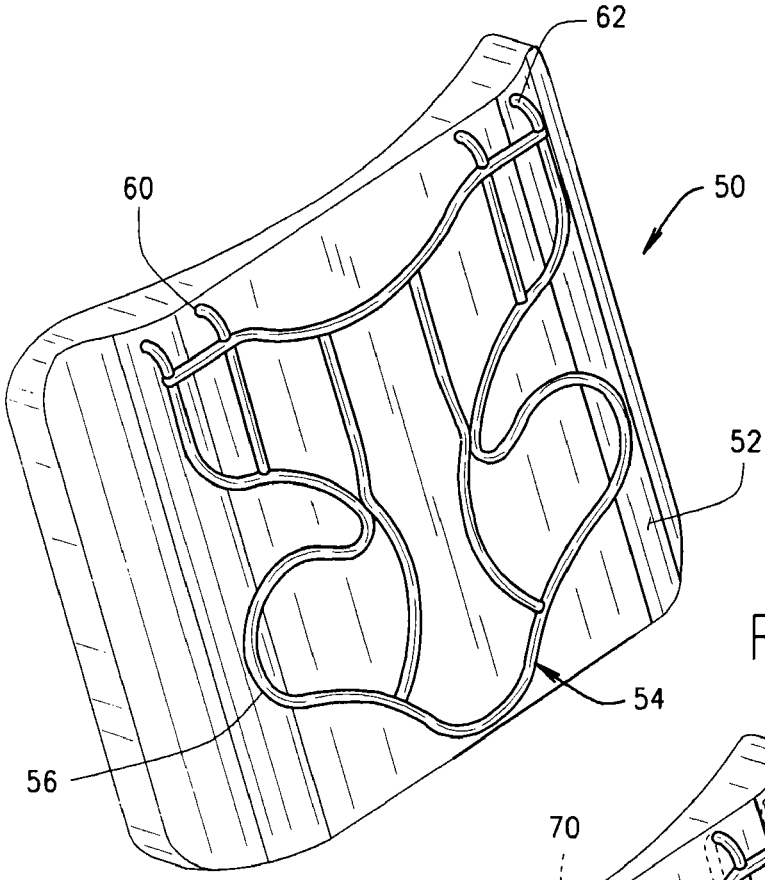
FIG. 7 is a rear perspective view of another aspect of a supportive back overlay.

Cover 18 can be constructed from a durable, washable fabric, such as nylon or the like. Cover 18 has a back wall 34 with an external surface 36 that contacts the front surface of the sling back and hence preferably is constructed from a material having a higher coefficient of friction or tackiness, such as a rubberized fabric, that keeps the supportive back from sliding or moving when attached to the sling back. As seen in FIG. 7, cover 18 has a top opening 38 covered by a closable flap 40 that opens into a main inside compartment 42 that is sized and configured to snugly hold cushion 16. Flap 40 can be closed by hook and loop fastener or other appropriate means. Inside compartment includes pocket 44 defined by back wall 34 and an inner wall 45 for the insertion of front section 22 of suspension element 12. In the illustrated embodiment, there is a pair of opposed snaps 46 between the back wall 32 and wall 45. When front section 22 of the suspension element is positioned in the pocket, the snaps 46 are engaged so that the back wall and pocket are fastened together with the front section 22 of the suspension element secured in-between, keeping front section 22 from sliding around in the pocket.

When assembled, cushion 16 and the front section 22 of the suspension element 12 are secured inside cover 18. Bails 26 and 28 and rear section 24 of the suspension element are exposed. Bails 26 and 28 are dimensioned so that there is a space 48 between rear section 24 of the suspension element and back wall 34 if the cover. The user can slide the suspension element over the upper edge of the sling back and suspend or hang the supportive back 10 on the original back. The front and rear sections 22 and 24 of suspension element 12 provide support and stability. The suspension element 12 and cushion 16 are sufficiently wide to extend substantially across the sling back to provide a firmer, more comfortable seat back by supplementing the original equipment sling back B. Cushion 16 flattens and firms up the sling back. The supportive back overlay 10 can be provided in an array of sizes. It can be attached to just about any chair back and is easily removed. It requires no modification of the wheelchair frame, any specialized equipment, clamps or tools to attach or remove.

In the illustrated embodiment, suspension element 12 is shown removably secured in pocket 44 of the cover. This facilitates disassembly of the supportive back so the cover may be washed or the cushion replaced and so forth. However, the suspension element, whatever configuration used, can be more permanently attached to the cover, or may be removably attached by some other arrangement. The support element 14 could include hook-like means on the upper edge, either short or longer, for example designed like staffs with the vertical body of the staff extending the vertical length of the support element to provide addition stability and so forth.

Figure 8:
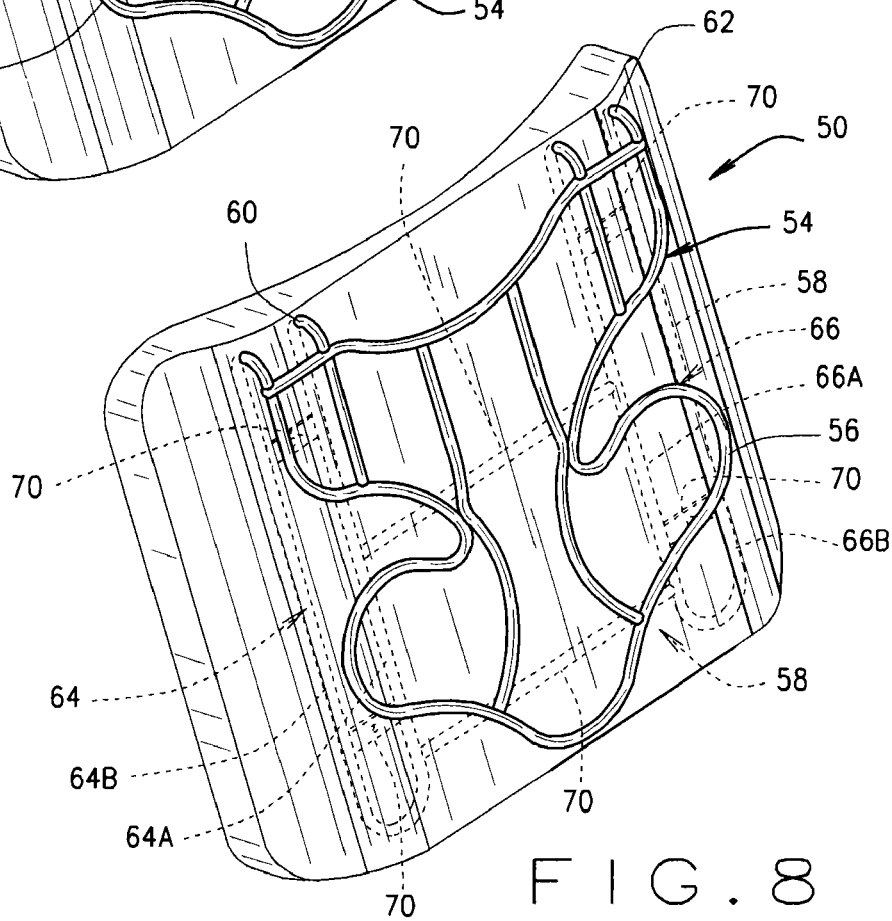
FIG. 8 is another rear perspective view of an aspect of a supportive back overlay of FIG. 7.

Another representative embodiment of a supportive back overlay, indicated by reference number 50 in the drawings, is shown in FIGS. 7 and 8. Supportive back overlay 50 includes a contoured, molded foam cushion 52 and a suspension element 54. Suspension element 54 includes a first or outer section or side 56 and a second, spaced apart section or side 58. As shown, second side 58 is molded into foam cushion 52. Pairs of bails 60 and 62 extend up and out of the cushion. First side 56 is spaced apart from the back of cushion 52 so that the pairs of bails 60 and 62 can be placed over the upper edge of a chair sling back, allowing the cushion to be suspended in front of the sling back to support the back of a seated user. The configuration of the two sides (56, 58) of suspension element 52 can be of any desired configuration. The two sides do not necessarily have to be mirror images. However, second side 58 that is molded inside cushion 52 should be of a substantial area and configuration so as to me molded securely within the cushion. As show, the configuration of the first side 56 is lobed, similar to suspension element 12. Second side 58 is substantially rectangular, having spaced apart vertical members 64 and 66 comprised of spaced apart vertical members 64A, 64B and 66A and 66B. Each pair of vertical members can be connected by cross braces 70. It will be appreciated that the curved sections of these vertical members that protrude out of the foam cushion form the pairs of bails 60, 62. In any event, vertical members 64A and 66A can be connected by horizontal members 72 to add rigidity. As stated above, any configuration of the suspension element is intended to be within the scope of the invention.

Figure 9:
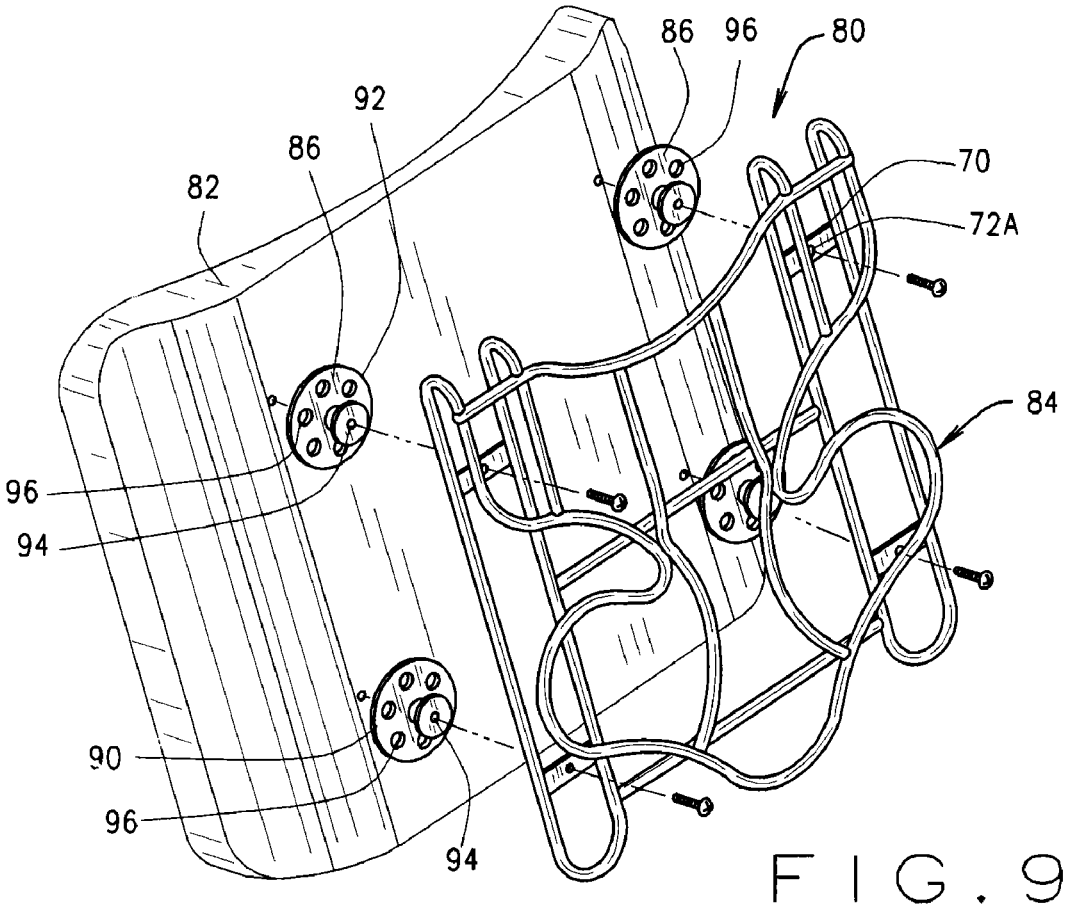
FIG. 9 is another rear perspective exploded view of an aspect of a supportive back overlay with a portion of the clip molded into the foam cushion shown in phantom.
Figure 10:
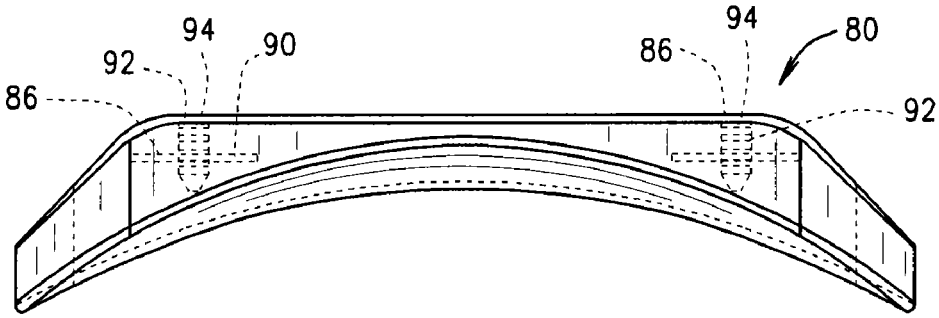
FIG. 10 is a top plan view of the supportive back overlay of FIG. 9.

FIGS. 9 and 10 illustrate and other representative embodiment of the supportive back overlay of the present invention, indicated generally by reference number 80. Supportive back overlay 80 includes a cushion 82 and a suspension element 84. Suspension element 82 is configured similarly to suspension element 54 described above. However, supportive back overlay 80 includes four spaced apart anchors 86 molded into cushion 82. Anchors 86 protrude from adjacent the four corners of the flat back wall 88 of cushion 82. As shown, anchors 86 have a substantially circular body 90 with a concentric, spindle-like protrusion 92. Protrusion 92 defines a central, threaded bore 94. Circular body 90 has a pattern of perforations or holes 96. Circular body 90 is molded within the cushion during the molding process and the holes 96 fill with foam material during the molding process to better secure the anchors in the cushion.

Suspension element 84 includes four cross braces 70, of the type described above in reference to suspension element 54. Cross braces 70 define centrally placed holes 72A. Screws 98 extend through holes 72A of the four cross braces and threadedly engage threaded bore 94 to secure suspension element 84 to the back of cushion 82. Supportive back overly 80 is suspended on a sling back B in manner similar to that described above.

Figure 11:
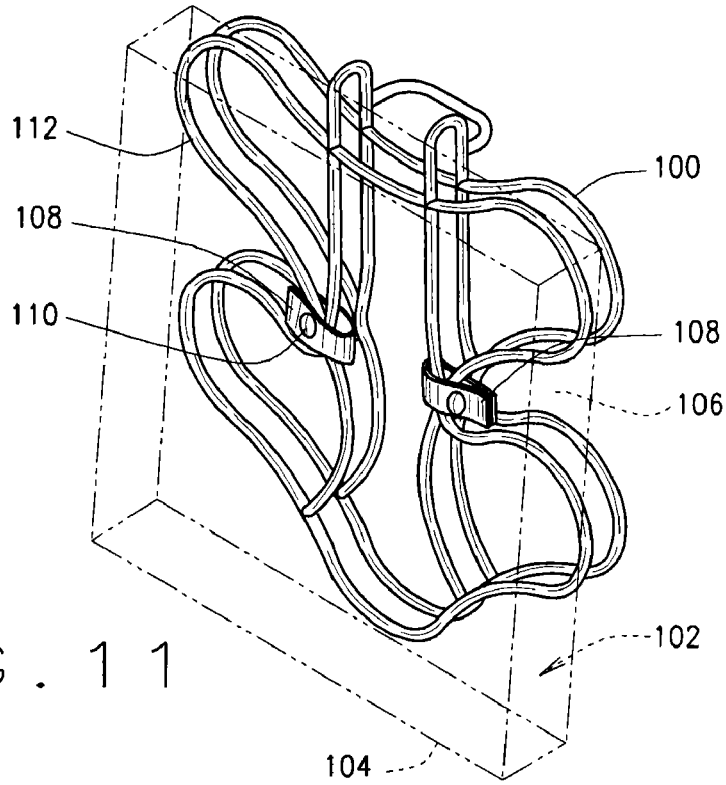
FIG. 11 is front perspective view of another aspect of a support back overlay suspension element partially enclosed in a cover, with a cover shown in phantom.
Figure 12:
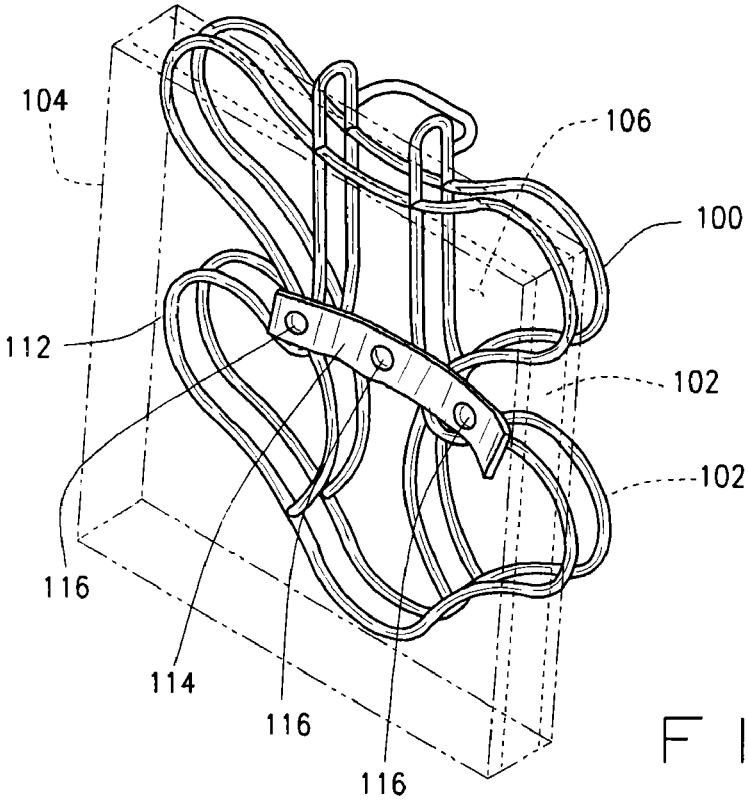
FIG. 12 is front perspective view of another aspect of a support back overlay suspension element partially enclosed in a cover, with the cover shown in phantom.

FIGS. 11 and 12 illustrate alternative ways to attach a suspension element 100 in an inner pocket 102 of a cover 104. Cover 104 includes a back wall 106. In FIG. 11, there are a pair of spaced apart, opposed tabs 108 secured to the inside face of back wall 106. Tabs 108 include a snap 110. A second side 112 of suspension element 100 is positioned within pocket 102. The tabs 108 are secured around a narrow area of side 112 and snapped, thereby securing second side 112 inside the cover. A cushion then can be inserted in pocket 102. The snaps 108 can be unsnapped to remove the suspension element from the cover. Similarly, in FIG. 12 a single, longer securing strip 114 can be placed across a narrow area of the second side 112 of a suspension element and secured to the back wall 106 with a series of snap 116 to releasably hold the second side of the suspension element within pocket 102 of cover 104.

It will be appreciated that the foregoing written description and accompanying drawings are illustrative only, demonstrating the best mode of working the invention presently known to the inventor, and should not be used to construe the scope of the invention or claims in a limiting sense.

The invention claimed is:

1. A supportive back for mounting on a backrest of a chair, said supportive back comprising a suspension frame for attachment to the backrest of the chair, the suspension frame including a substantially flat first frame section having a top and a bottom and a spaced apart substantially flat second frame section having a to and a bottom in planar alignment with the first frame section, said first frame section and said second frame section connected to each other at their respective tops only; and a support element secured to the first frame section of the suspension element wherein the first frame section and said second frame section are connected to each other at their respective tops by at least one bail.

2. The supportive back of claim 1 further comprising a cover on the support element with the first frame section of said suspension frame enclosed in the cover.

3. The supportive back of claim 1 wherein the support element is a molded foam cushion.

4. The supportive back of claim 3 wherein the first frame section of said suspension frame is molded into the molded foam cushion.

5. The supportive back of claim 1 wherein the support element is secured to the first frame section of the suspension element with anchors.

6. A supportive back overlay that can be retrofitted to an original equipment wheelchair back, said supportive back overlay comprising a supportive cushion and an associated wire frame suspension element having a to and a bottom, a substantially flat first section and a spaced apart substantially flat second section in planar alignment with the front section, said first and second sections being connected at the top, with the wire frame being open at the bottom and disposed to mount over the original equipment wheelchair back to hold the cushion in position behind a seated user's back wherein said supportive cushion includes an attachment apparatus and said suspension element is attached to the attachment apparatus.

7. The supportive back overlay of claim 6 further comprising a cover on the supportive cushion.

8. The supportive back overlay of claim 7 wherein said cover defines an inner compartment with the supportive cushion and the first section of the suspension element secured within the inner compartment.

9. The supportive back overlay of claim 8 wherein the inner compartment of the cover comprises at least one securing strap for securing the first section of the suspension element within the inner compartment.

10. The supportive back overlay of claim 6 wherein the attachment apparatus is at least one anchor affixed to the supportive cushion and the suspension element is attached to the at least one anchor.

11. A supportive back that can be suspended on the backrest of a chair, comprising a support element for positioning on a front side of the backrest and a suspension element having a front section associated with the support element for positioning on the front side of the backrest, a back section for positioning on a backside of the backrest, and at least one bail connecting the front section and the back section for suspending the support element on the backrest of the chair.

12. The supportive back of claim 11 further comprising a cover, with the support element and the front section of said suspension element contained in the cover.

13. The supportive back of claim 11 wherein the support element is a molded foam cushion.

14. The supportive back of claim 11 wherein the front section of the suspension element is attached to the support element.

* * * * *